US006799657B2

(12) United States Patent
Daniels

(10) Patent No.: US 6,799,657 B2
(45) Date of Patent: Oct. 5, 2004

(54) ABSORPTIVE/REACTIVE MUFFLER FOR VARIABLE SPEED COMPRESSORS

(75) Inventor: Mark A. Daniels, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/263,003

(22) Filed: Oct. 2, 2002

(65) Prior Publication Data

US 2004/0065504 A1 Apr. 8, 2004

(51) Int. Cl.[7] ..... F01N 1/10

(52) U.S. Cl. ..... 181/252; 181/247; 181/222; 181/212; 181/175; 181/248; 181/228; 181/256; 181/270

(58) Field of Search ..... 181/212–214, 181/222, 227, 247–252, 269–270, 253–258, 263, 283, 41–48, 266, 243, 160; 29/890.08; 180/296, 167; 60/299

(56) References Cited

U.S. PATENT DOCUMENTS

| | | | | | |
|---|---|---|---|---|---|
| 3,104,733 | A | * | 9/1963 | Ludlow | 181/227 |
| 3,631,792 | A | * | 1/1972 | Bodine | 60/299 |
| 3,648,803 | A | * | 3/1972 | Heath et al. | 181/250 |
| 3,894,610 | A | | 7/1975 | Halter et al. | |
| 3,920,095 | A | * | 11/1975 | Clark | 181/248 |
| 4,185,715 | A | * | 1/1980 | Reu Boiu | 181/266 |
| 4,294,330 | A | * | 10/1981 | Baldwin et al. | 181/230 |
| 4,359,136 | A | * | 11/1982 | Eriksson | 181/269 |
| 4,487,289 | A | * | 12/1984 | Kicinski et al. | 181/252 |
| 4,923,003 | A | * | 5/1990 | Stenlund | 165/165 |
| 4,923,033 | A | * | 5/1990 | Panick et al. | 181/211 |
| 5,010,977 | A | * | 4/1991 | Furukawa et al. | 381/96 |
| 5,317,112 | A | * | 5/1994 | Lee | 181/250 |
| 5,449,866 | A | * | 9/1995 | Moss | 181/228 |
| 5,475,976 | A | * | 12/1995 | Phillips | 60/327 |

FOREIGN PATENT DOCUMENTS

| | | | | |
|---|---|---|---|---|
| DE | 35 17 859 A | | 11/1986 | |
| EP | 0 274 659 A | | 7/1988 | |
| FR | 2 713 701 A | | 6/1995 | |
| JP | 03003913 A | * | 1/1991 | F01N/1/10 |

* cited by examiner

*Primary Examiner*—David Martin
*Assistant Examiner*—Renata McCloud

(57) ABSTRACT

An absorptive and reactive muffler includes an annular flow path for the gas with the center of the annulus having a plurality of resonators which are in open communication with the downstream end of the annular flow path and make up the reactive portion of the muffler. The flow path is at least partially lined by an absorptive material overlain by a perforate material and makes up the absorptive portion of the muffler.

10 Claims, 1 Drawing Sheet

ABSORPTIVE/REACTIVE MUFFLER FOR VARIABLE SPEED COMPRESSORS

BACKGROUND OF THE INVENTION

In positive displacement compressors, discrete volumes of gas are trapped and compressed with the trapped, compressed volumes being discharged from the compressor. The trapping of the volumes at suction pressure and their discharge at discharge pressure each produce pressure pulsations and the related noise generation. While mufflers can be made to attenuate noise in a particular frequency range, or ranges, variable speed compressors may operate over ranges beyond the effective range(s) of conventional absorptive mufflers. This may be due to operating at rotational speeds outside the peak performance region of the absorptive device or at speeds where absorptive techniques are inadequate e.g. at frequencies well below the quarter wave thickness of the absorptive material. Accordingly, there would be no effective attenuation of a variable speed positive displacement compressors over some ranges of normal operation where conventional absorptive mufflers are employed.

The flow of gas through a muffler is along a flow path defined by the pressure differential across the muffler. The direction of noise generation is not dictated by the flow direction. Reflected sound energy is generated each time there is a change in the cross section of the flow path with some of the sound energy being reflected in the opposite direction to that of the gas flow. It is through this mechanism that "reactive" type mufflers are designed to attenuate specific frequencies. In an absorptive muffler a portion of the flow path is defined by an absorptive material overlain by perforate metal, or the like. There is a trade off between flow resistance and noise reduction, with respect to the length and cross section of the flow path, in designing the muffler. Typical performance is limited by the relationship of the flow passage length to its height/minimum spacing in an absorptive device with peak attenuation occurring at a frequency related to the depth and impedance characteristics of the liner material.

SUMMARY OF THE INVENTION

The present invention is directed to an absorptive/reactive muffler including a central cylindrical section having an opening, preferably, at the downstream end and containing a plurality of Helmholtz resonators, a mix of quarter and half wave resonators with each of the resonators being turned to a slightly different frequency to provide wider bandwidth attenuation characteristics or a combination of Helmholtz and quarter and/or half wave resonators. The central cylindrical section is serially overlain by an absorptive material and a first perforate material. The perforate material defines the inner surface of the flow path. A second perforate annular surface is underlain with an absorptive material and is spaced from the first perforate material and coacts therewith to define the fluid flow path. Noise traveling along the fluid flow path reflects between the two surfaces of absorptive material overlain by the perforate material and is attenuated by the absorptive material. Upon reaching the end of the annular flow path, the impedance discontinuity defined by the change in flow cross section directs some of the generated noise into the central cylindrical section containing the resonators. If necessary, or desired, the outer annular surface partially defining the annular flow path may be smooth rather than lined with absorptive material overlain by perforate material.

It is an object of this invention to provide performance enhancement over conventional absorptive mufflers.

It is a further object of this invention to provide a muffler having enhanced performance in a plurality of narrow frequency bands. These objects, and others as will become apparent hereinafter, are accomplished by the present invention.

Basically, the preferred muffler includes an annular flow path for the gas with the center of the annulus having a plurality of resonators which are in open communication with the downstream end of the annular flow path. The flow path is at least partially lined by an absorptive material overlain by a perforate material.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
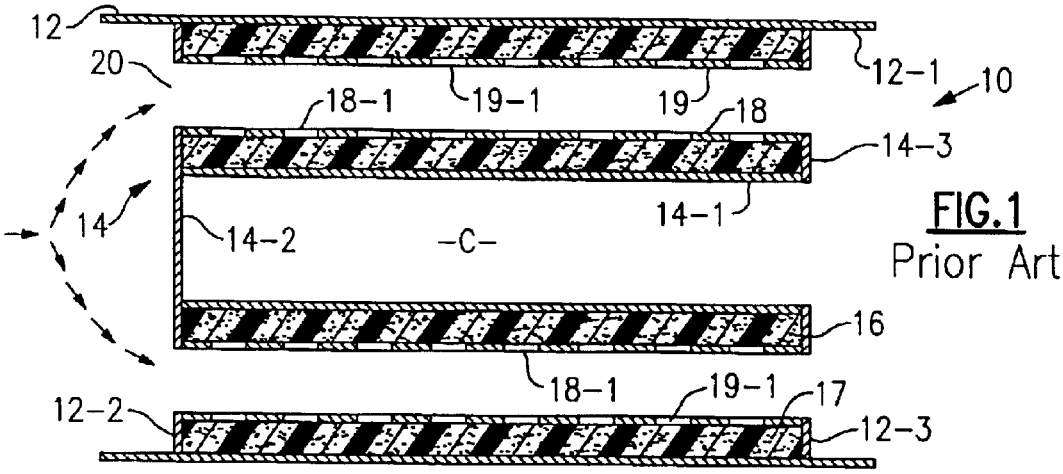
FIG.1 Prior Art
FIG. 1 is a sectional view of a PRIOR ART absorptive muffler.
Figure 2:
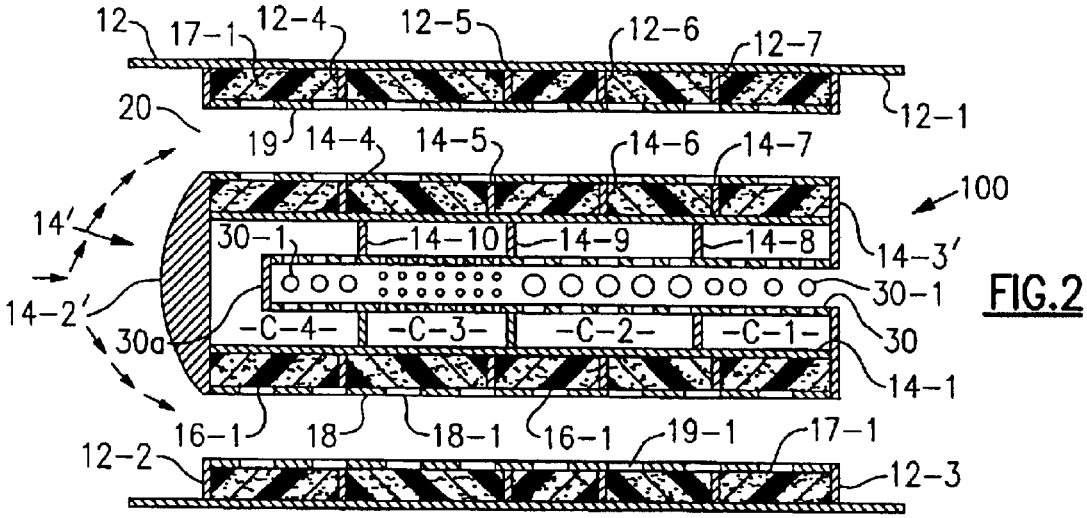
FIG. 2 is a sectional view of an absorptive/reactive muffler made according to the teachings of the present invention.
Figure 3:
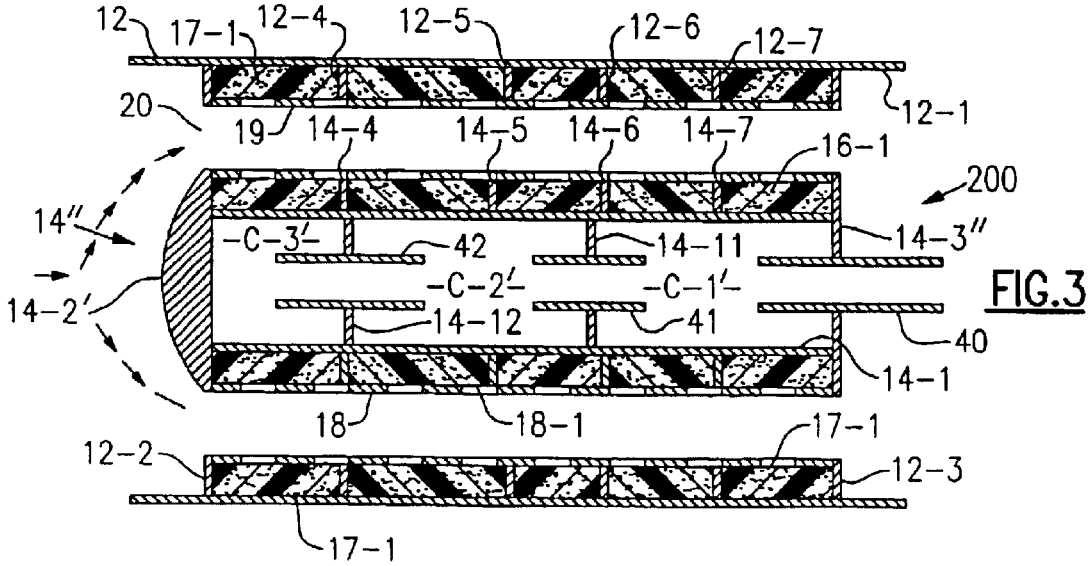
FIG. 3 is a sectional view of a modified absorptive/reactive muffler made according to the teachings of the present invention.

In FIG. 1, the numeral 10 generally designates a PRIOR ART absorptive muffler. Muffler 10 includes an outer hollow cylindrical housing portion 12 and an inner portion 14 which is suitably supported in said housing portion 12 and radially spaced therefrom so as to provide an annular flow path 20 therebetween. Inner portion 14 includes an inner cylindrical portion 14-1 closed at the upstream end by disc 14-2 which extends radially outward of the inner cylindrical portion 14-1. Annular disc portion 14-3 is located at the downstream end of cylindrical portion 14-1 and extends radially outward therefrom. Cylindrical portion 14-1 and disc 14-2 coact to define cylindrical chamber C which is open at its downstream end to the flow path 20 but does not form a part of the flow path. Acoustical lining 16 surrounds inner cylindrical portion 14-1 and is held in place axially by discs 14-2 and 14-3. Acoustical lining 17 lines a portion of the inner surface 12-1 of housing portion 12 and is held in place axially by annular discs 12-2 and 12-3. Acoustical linings 16 and 17 may be of any suitable material such as foam or fiberglass. Acoustical linings 16 and 17 are overlain by perforate members 18 and 19, respectively, which may be any suitable material such as plastic or metal.

In operation of muffler 10, gas flow and sound enter annular flow path 20 at the left side of FIG. 1 and exit at the right side of FIG. 1. The primary mechanism for reducing sound is the absorptive elements 16 and 17 located beneath perforate annuli 18 and 19, respectively, which form the outer surface of inner portion 14 and the inner surface of housing portion 12. In going through muffler 10 the sound reflects between the surface defined by perforate member 18 and the surface defined by perforate member 19 with sound passing through the perforations 18-1 of perforate member 18 and the perforations of 19-1 of perforate member 19 thereby being attenuated by absorptive elements 16 and 17, respectively. Chamber C, which is an empty volume, acts as a one quarter wave resonator which attenuates the sound in a narrow frequency range.

Muffler 100 differs from muffler 10 in replacing a single quarter wave resonator with a series of slightly mis-tuned Helmholtz resonators providing a wide band of sound reduction at problematic frequencies. Inner portion 14' is suitably supported in housing portion 12. Muffler 100 has all of the structure of muffler 10 except: (1) disc 14-2' has a hemispherical or other type of flow loss reducing geometry; (2) annular disc 14-3' has a smaller opening than annular disc 14-3; (3) acoustical lining 16 has been replaced by a plurality of segments 16-1 separated by discs 14-4, 14-5, 14-6 and 14-7; and (4) acoustical lining 17 has been replaced by a plurality of segments 17-1 separated by discs 12-4, 12-5, 12-6 and 12-7. The subdividing of acoustical lining 16 into segments 16-1 by solid disc separators 14-4, 14-5, 14-6 and 14-7 along the complete length of inner portion 14' is such that discs 14-4, 14-5, 14-6 and 14-7 prevent the acoustic wave from traveling the complete length of the material of all of segments 16-1 in the flow direction. Rather, acoustic waves are forced to penetrate the material of segments 16-1 in directions primarily normal to the flow direction only. This type of absorptive device is termed a "locally reacting" muffler rather than the bulk device of FIG. 1. Additionally, structure is located in the space corresponding to chamber C of muffler 10. Specifically, perforate cylindrical member 30, having a plurality of perforations 30-1 which may vary in size, extends within inner cylindrical portion 14-1 from annular disc 14-3' to a point short of the inner surface of end disc 14-2'. Perforate member 30 has a closed end 30*a* and is supported by annular end disc 14-3' and a plurality of inner annular discs with three discs, 14-8, 14-9 and 14-10, being illustrated. Inner cylindrical portion 14-1, perforate member 30 and discs 14-3', 14-8, 14-9 and 14-10 coact to define chambers C-1, C-2, C-3 and C-4 which define slightly mis-tuned Helmholtz resonators. Mistuning of chambers C-1 through C-4 is accomplished by varying the chamber volumes and/or the porosity through the number and/or hole size of perforations 30-1 communicating with each of the chambers C-1 through C-4.

In operation of muffler 100, the sound passing through the annular path 20 defined by the inner surface of housing portion 12 or perforate member 19 and the underlying absorptive element 17 and the surface defined by perforate member 18 and the underlying absorptive elements 16-1 is the same as in the case of muffler 10. The difference and improvement provided by muffler 100 over muffler 10 is that due to the replacement of the single quarter wave resonator defined by chamber C with the Helmholtz resonators defined by chambers C-1, C-2, C-3 and C-4. The Helmholtz resonators are similar but not identical and so are able to attenuate a range of frequencies. The attenuated frequencies may be specific frequencies, a wider band of frequency by slight mistuning, or a combination of both.

Muffler 200 differs from muffler 10 in replacing a single quarter wave resonator with a plurality of quarter and/or half wave resonators. Inner portion 14' is suitably supported in housing portion 12. Muffler 200 differs from muffler 100 in having a plurality of quarter and/or half wave resonators rather than a plurality of Helmholtz resonators. Muffler 200 has all of the structure of muffler 10 except disc 14-2' has a hemispherical or other type of flow loss reducing geometry and annular disc 14-3" has a smaller opening than annular disc 14-3 and supports tube 40. In addition to tube 40, tube 41 supported by annular disc 14-11 and tube 42 supported by annular disc 14-12 are located in the space corresponding to chamber C of muffler 10. Tubes 40, 41 and 42 are axially spaced and of different lengths. Inner cylindrical portion 14-1, tubes 40, 41 and 42 and discs 14-3", 14-11 and 14-12 coact to define chambers C-1', C-2' and C-3' and slightly mis-tuned quarter and half wave resonators. For example, half wave resonators are defined by tubes 40, 41 and 42 terminating with open-open end boundary conditions while one quarter wave resonators are defined by open-closed end boundary conditions.

The operation of muffler 200 is the same as that of muffler 10 and 100 relative to the sound passing through the annular path 20 defined by the inner surface of outer housing portion 12 or perforate member 19 and the underlying absorptive elements 17-1 and the surface defined by perforate member 18 and the underlying absorptive element 16. The difference and improvement provided by muffler 200 over muffler 10 is that due to the replacement of a single quarter wave resonator defined by chamber C with a plurality of quarter and/or half wave resonators which are similar but not identical. The resonators collectively are able to attenuate a range of frequencies which may, for example, be specific frequencies, a wider band of frequencies by slight mistuning of the length of tubes 40, 41 and/or 42, or by a combination of both.

Although preferred embodiments of the present invention have been illustrated and described, other changes will occur to those skilled in the art. For example, the number and combination of types of resonators and the degree of mistuning will depend upon the specific application of the teachings of the present invention. Also, while segments are preferred, absorptive elements 16-1 an 17-1 may be made as single elements. It is therefore intended that the scope of the present invention is to be limited only by the scope of the appended claims.

What is claimed is:

1. An absorptive and reactive muffler for attenuating noise over a range of frequencies comprising:

a hollow outer member having an inlet and an outlet;

an inner member located within said hollow member in a spaced relationship and coacting therewith to define a flow path between said inlet and said outlet;

said inner member having a closed upstream end and an open downstream end;

said inner member including a hollow inner member extending from said closed upstream end to said downstream end;

at least a portion of said flow path being defined by an absorptive material and a perforate member overlying said absorptive material;

a plurality of resonators located in said hollow inner member in an axially spaced relationship, with each of said plurality of resonators being responsive to a different frequency range, whereby said plurality of resonators are collectively responsive to a wider frequency range.

2. The absorptive and reactive muffler of claim 1 wherein said plurality of resonators is made up of at least one Helmholtz resonator.

3. The absorptive and reactive muffler of claim 1 wherein said plurality of resonators includes at least one quarter wave resonator.

4. The absorptive and reactive muffler of claim 1 wherein said plurality of resonators includes at least one half wave resonator.

5. The absorptive and reactive muffler of claim 1 wherein at least a portion of said absorptive material is separated by spacers spaced along said flow path.

6. An absorptive and reactive muffler for attenuating noise over a range of frequencies comprising:

a hollow outer member having an inlet and an outlet;

an inner member located within said hollow member in a spaced relationship and coacting therewith to define a flow path extending between said inlet and said outlet;

said inner member having a closed upstream end and a downstream end which is open to said flow path;

said inner member including a hollow inner member extending from said closed upstream end to said downstream end and having an open end which is open to said flow path;

at least a portion of said flow path being defined by an absorptive material and a perforate member overlying said absorptive material;

a plurality of resonators located in said hollow inner member in an axially spaced relationship, with each of said plurality of resonators being responsive to a different frequency range, whereby said plurality of resonators are collectively responsive to a wider frequency range.

7. The absorptive and reactive muffler of claim 6 wherein said plurality of resonators is made up of at least one Helmholtz resonator.

8. The absorptive and reactive muffler of claim 6 wherein said plurality of resonators includes at least one quarter wave resonator.

9. The absorptive and reactive muffler of claim 6 wherein said plurality of resonators includes at least one half wave resonator.

10. The absorptive and reactive muffler of claim 6 wherein at least a portion of said absorptive material is separated by spacers spaced along said flow path.

* * * * *